US005974966A

United States Patent [19]

Bruni

[11] Patent Number: 5,974,966

[45] Date of Patent: Nov. 2, 1999

[54] INK KNIFE FOR THE INK DUCT ROLLER OF A PRINTING MACHINE

[75] Inventor: Hanspeter Bruni, Welsikon-Dinhard, Switzerland

[73] Assignee: Sycolor Consulting AG, Switzerland

[21] Appl. No.: 09/051,576

[22] PCT Filed: Oct. 17, 1996

[86] PCT No.: PCT/CH96/00365

§ 371 Date: Apr. 14, 1998

§ 102(e) Date: Apr. 14, 1998

[87] PCT Pub. No.: WO97/14562

PCT Pub. Date: Apr. 24, 1997

[30] Foreign Application Priority Data

Oct. 19, 1995 [CH] Switzerland ..... 2964/95

[51] Int. Cl.[6] ..... B41F 1/00

[52] U.S. Cl. ..... 101/169; 101/170

[58] Field of Search ..... 101/169, 167, 101/365, 363, 170; 15/256.5, 256.51, 256.52

[56] References Cited

U.S. PATENT DOCUMENTS

| | | | |
|---|---|---|---|
| 2,837,024 | 6/1958 | Dougan | 101/101 |
| 4,406,224 | 9/1983 | Hajek | 101/363 |
| 4,676,160 | 6/1987 | Linska | 101/365 |
| 4,773,327 | 9/1988 | Moetteli | 101/169 |
| 5,461,979 | 10/1995 | Bruni | 101/365 |
| 5,694,850 | 12/1997 | Pickard | 101/169 |

FOREIGN PATENT DOCUMENTS

| | | | |
|---|---|---|---|
| 0376885 | 7/1990 | European Pat. Off. . | |
| 0594536 | 4/1994 | European Pat. Off. . | |
| 3100383 | 1/1982 | Germany | 101/169 |
| 3525589 | 4/1986 | Germany . | |
| 3707570 | 9/1988 | Germany | 101/365 |
| 4323047 | 3/1995 | Germany . | |
| 602345 | 7/1978 | Switzerland . | |
| 2156276 | 10/1985 | United Kingdom | 101/365 |

*Primary Examiner*—Edgar Burr
*Assistant Examiner*—Anthony H. Nguyen
*Attorney, Agent, or Firm*—Bachman & LaPointe, P.C.

[57] ABSTRACT

A process is disclosed for producing an ink knife for the ink duct roller of a printing machine from an at least about 2 mm thick metal plate. Parallel slits are formed which extend from the working edge of the ink knife over part of the plate width and form lamellas of color zone width. Parallel transverse and blind-ended grooves which start at the working edge are first cut into the metal plate at intervals which correspond to the width of the color zones. Afterwards, a continuation rating groove that extends parallel to the working edge is cut in the area of the blind ends of the transverse grooves, preferably on at least one side of the metal plate. Finally the metal plate is completely cut through in the area of the transverse grooves, preferably by means of laser beams, forming a narrow slit at intervals which correspond to the width of the color zones.

19 Claims, 2 Drawing Sheets

INK KNIFE FOR THE INK DUCT ROLLER OF A PRINTING MACHINE

BACKGROUND OF THE INVENTION

The invention relates to a process for production of an ink knife for an ink duct roller of a printing machine from a metal plate at least 2 mm thick, where parallel slots are formed which extend at right angles from the working edge of the ink knife over part of the plate width and form blades of ink zone width.

Multiple-blade ink knives are known for example from CH-A5 602345. This ink knife has in the area of the working edge recesses which lie on both sides of adjustment screws next to the blades. The blades can be adjusted individually, a mechanical influence on the adjacent blade area is excluded or at least substantially reduced. The thickness of the ink layer can be set on each blade, individual ink amounts in the different ink zones can be changed as required by the printing image in the different ink zone widths. The disadvantage of this solution is the intermediate spaces between the blades which allow the passage of even high viscosity inks and the formation of annular rings on the ink ductor.

According to the known state of the art, various measures are proposed which prevent at least in part the penetration of ink into the slots but always entail other disadvantages.

According to DE, A1 2228625, the slots between the blades of an ink knife are filled with a plastic. This mechanically decouples adjacent blades thanks to the elasticity of the plastic. As the usage period increases however there is an increasing risk that parts of the plastic, in particular when a blade is greatly deflected in comparison with its neighbor, will come loose and harm the print quality.

Numerous design forms are known according to which the slots between the blades of an ink knife are covered either with a metal or with a plastic foil, for example according to U.S. Pat. No. 2837024. These cover foils are effective but cause substantial problems for example as a result of wear and penetration of the ink between the foil and the blades.

In DE, C1 3525589, the working edge of an ink knife is slotted with a wire erosion machine or with laser beams. An adhesive coating of a material softer than the ink knife has a greater thickness than the width of the slot. When the blade is adjusted, the excess material is cut away and the slot completely closed. The penetration of ink into the narrow slot is prevented with complex measures.

According to EP, B1 0376885, ink knives are produced which have slots formed by laser beams of a width of 0.1 to 0.3 mm, which prevents leakage without additional cover in the case of high viscosity printing inks. In addition to the defined slot widths, the ink knife must have the following properties:

The slots must be longer than half the plate width but must not exceed two-thirds thereof.

The thickness of the plate must be at least twice the maximum adjustment path of the blades.

Preferred plate thicknesses are 1 to 3 mm. It has been shown that in the thicker plate range extremely narrow slots from 0.01 to 0.03 mm width can only be cut out cleanly and regularly with great difficulty, if at all. Furthermore this solution is limited to high viscosity inks.

SUMMARY OF THE INVENTION

The present invention is based on the task of creating a process of the type described above which considerably facilitates and rationalizes the production of narrow slots in particular with laser beams. In particular with a metal plate thickness of at least 2 mm, an extremely narrow regular cut can be made with laser beams and the blades formed, despite their thickness, can be adjusted with appropriate use of force. Furthermore there is the option of preventing or at least reducing by additional means the harmful consequences of ink of a lower viscosity range penetrating the slot.

The task is solved according to the present invention in that:

(a) blind-ended, parallel, transverse grooves are cut out of the metal plate at intervals corresponding to the ink zone width, starting from the working edge, and (b) the metal plate is cut through in the area of the transverse grooves to form a narrow slot at intervals corresponding to the ink zone width.

Special and further design forms of the process are the subject of dependent patent claims.

The process according to the invention creates the possibility, even when thick metal plates are used, of constructing ink knives with extremely narrow slots without the occurrence of technical problems which are difficult to solve. The thickness of the metal to be cut preferably by the laser beam is always less than the thickness of the metal plate. This residual thickness is limited by the deflection of the blades on adjustment to an ink duct roller. As this adjustment path in practice is relatively small, the transverse grooves can be formed correspondingly deep and hence facilitate the slot formation by the preferred laser process.

Even with very great plate thicknesses, the mobility of the blades is always guaranteed to the required extent as suitably at the blind slot end on at least one side of the metal plate a weakening groove of selectable depth is provided.

However it is of essential importance that (b) is always carried out after (a), otherwise the benefits of laser cutting through a thinner metal layer cannot be exploited and this would no longer correspond to the present invention.

The transverse grooves are preferably cut out at a width of 50 to 200% of the plate thickness at a depth of 20 to 80% of this plate thickness. For production of an ink knife, suitably a metal plate of spring steel is used which is 2 to 5 mm, in particular 3 mm thick. The depth of the transverse grooves in this case is preferably in the range from 1 mm to d−1 mm, where d indicates the thickness of the metal plate.

The cross sectional form of the transverse grooves is not significant in itself; in addition to rectangular, square, trapezoid, semi-circular or circle segment shape, it can assume any other form suitable for production. Usually transverse grooves of rectangular section are milled out of a metal plate before or after the plate is hardened. Suitably in a subsequent working process the weakening groove is milled out of the metal plate on the same side.

The longitudinal weakening grooves can however also be cut out on both sides of the plate. When formed on one and both sides, a semi-circular or circle-segment shaped cross section form is particularly suitable for a weakening groove. As indicated however the weakening groove can also be rectangular, square or even formed as a simple broad cut corresponding to the cross section form of the transverse grooves. Depending on the adjustment force available for the blades on the ink duct roller, the weakening groove or grooves are recessed more or less deeply.

The slots usually produced with the laser beams between the blades suitably have a width of maximum approx 0.1 mm, preferably max. 0.05 mm, in particular 0.01 to 0.02 mm. The narrower the slot, the less ink can penetrate if this is not of high viscosity. In particular in the upper range of slot widths, instead of the laser beams an equivalent process can be used for example wire erosion.

According to a further design form of the invention, the transverse grooves are filled with an elastic mass which does not penetrate the grooves. This ensures a perfect seal of the slots. This mass, in no case metallic, preferably consists of a plastic, an acid resistant silicon mass or an inserted rubber profile, for example a rubber cord. Evidently, if required, the weakening groove can also be filled with the elastic mass.

According to a preferred design form of the invention, the transverse grooves in the metal plate are covered at least in the area of the working edge with a first leg of an angled scraper. Its second freely projecting leg is bent or folded through an angle of preferably 30 to 60°. The angled scraper consists for example of a 0.05 to 0.1 mm thick metal plate or a plastic profile.

The first leg of the angled scraper is preferably glued to the blades of the metal plate. Thanks to the transverse grooves, the individual blades for adjustment have the necessary freedom of movement without mechanical effect on adjacent blades.

BRIEF DESCRIPTION OF THE DRAWINGS

The invention is described in more detail using the design examples shown in the drawings which show.

DETAILED DESCRIPTION OF PREFERRED EMBODIMENTS

Figure 1:
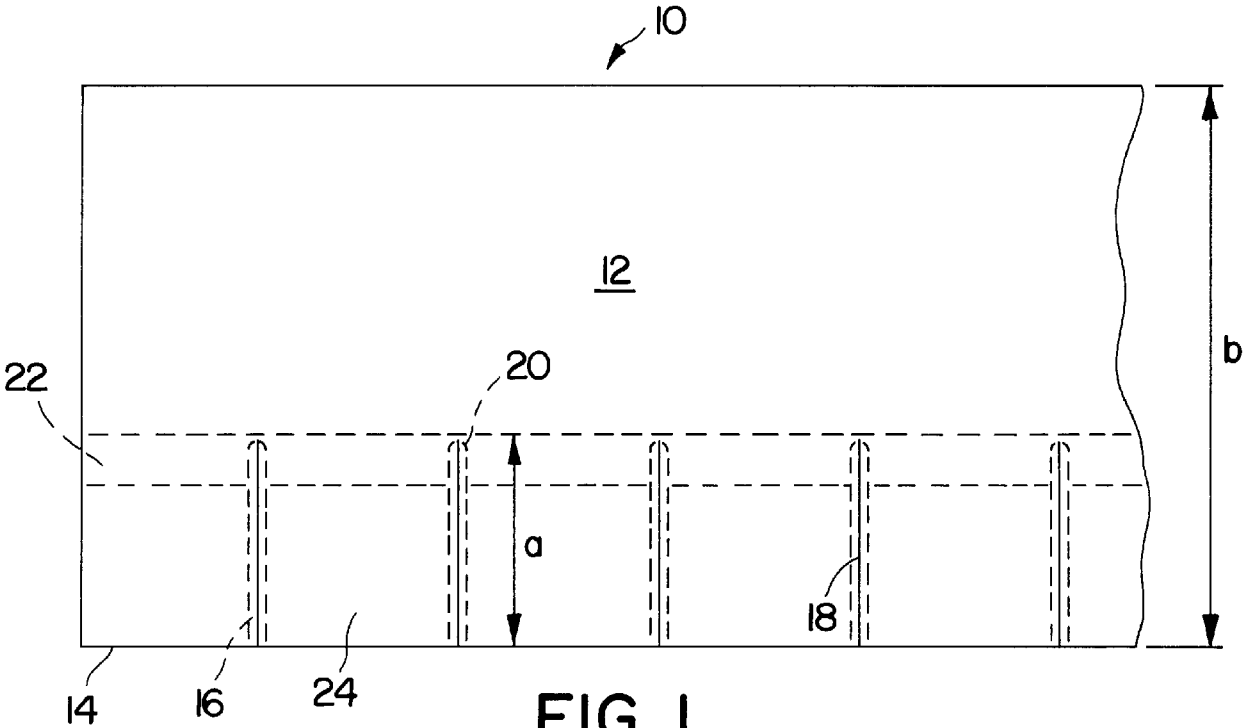
FIG. 1 a partial top view of an ink knife.
Figure 2:
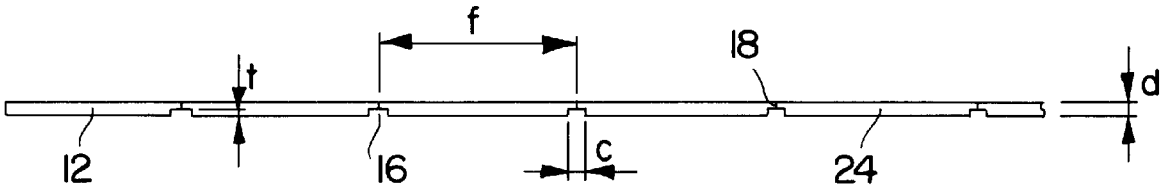
FIG. 2 a front view of FIG. 1.
Figure 3:
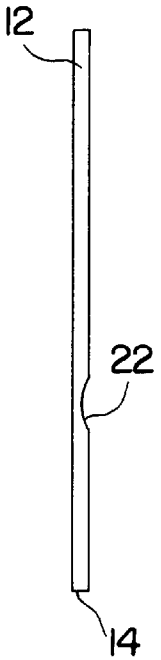
FIG. 3 a side view of FIG. 1.

An ink knife 10 shown in FIGS. 1 to 3 essentially consists of a metal plate 12 of spring steel which has a width b of 90 mm and a thickness d of 3.5 mm. Starting from a working edge 14, transverse grooves 16 running parallel are cut out at a right angle and have a depth t of 1.5 mm and a width c of 2.5 mm. The transverse grooves extend over a distance a of approximately 35 mm in relation to width b of the metal plate 12.

In the longitudinal center plane of the transverse grooves 16 runs a slot 18 produced by laser beam said which is of 35 mm length and 0.015 mm width and 2 mm depth which serves to form the blades.

In the area of the blind ends 20 of the transverse grooves 16, parallel to working edge 14, runs a recessed weakening groove 22 of circle-segment cross section. This has a radius of curvature of approximately 5 mm and is cut 1.5 mm deep, as are the transverse grooves 16. Thanks to this weakening groove 22 the blades 24, which form an ink zone width f, can move vertically to the plane of metal plate 12 with little use of force.

Figure 4:
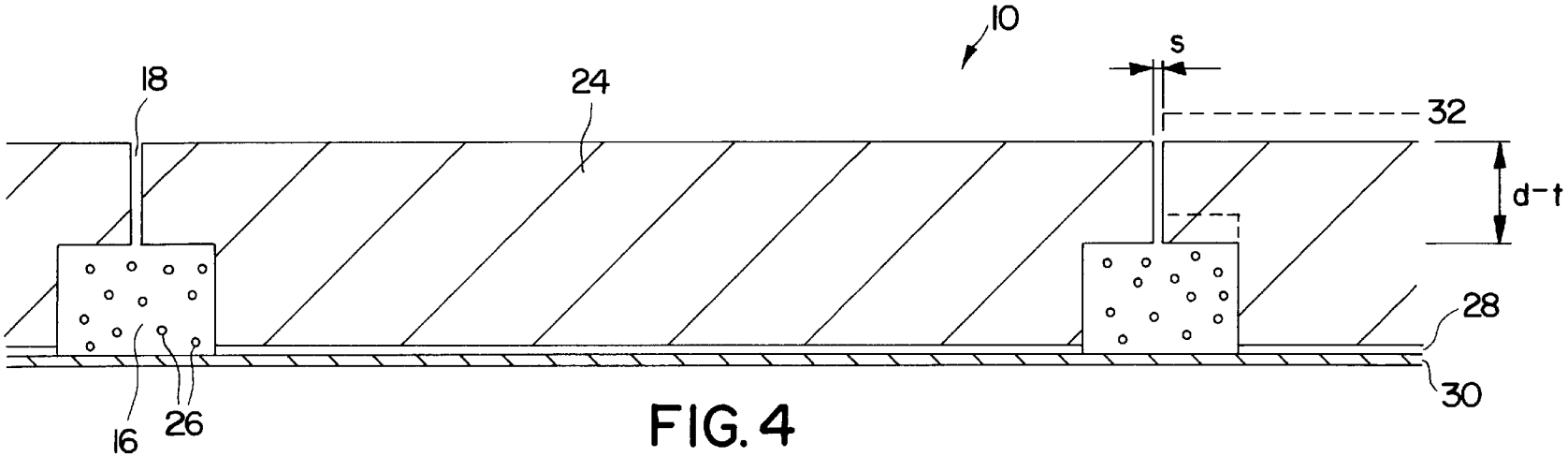
FIG. 4 an enlarged partial longitudinal section through the ink knife in the area of the blades, and FIG. 5 a partial side view of an ink knife with an angled scraper.

FIG. 4 shows more clearly the slot 18 of width s 0.015 mm formed by laser beam between the blades 24. The transverse grooves 16, again rectangular in cross section, are filled with an elastic mass 26, in the present case an acid-resistant silicon mass. An angled scraper 38 (FIG. 5) is attached to the blades with an adhesive layer 28. Only the first leg 30 of this angled scraper is visible in FIG. 4.

If the right blade 24 is pushed into the position 32 shown by dotted lines, for example by an adjustment screw not shown, the adjacent center blade 24 is not moved with it in sympathy because the broad transverse groove 16 has a compensatory effect. If the transverse groove 16 were only narrow, the adjacent blade 24 would be moved in sympathy. The narrow slot s however persists even when the right blade 24 is moved. The residual material thickness d-t in the area of working edge 14 is sufficiently large to keep slot 18 unchangingly narrow when a blade 24 is moved in the direction of the blade plane. In other words the adjustment of the blades to change the quantity of ink supplied is never so great that adjacent blades 24 shear away from each other and no longer form slot 18.

Figure 5:
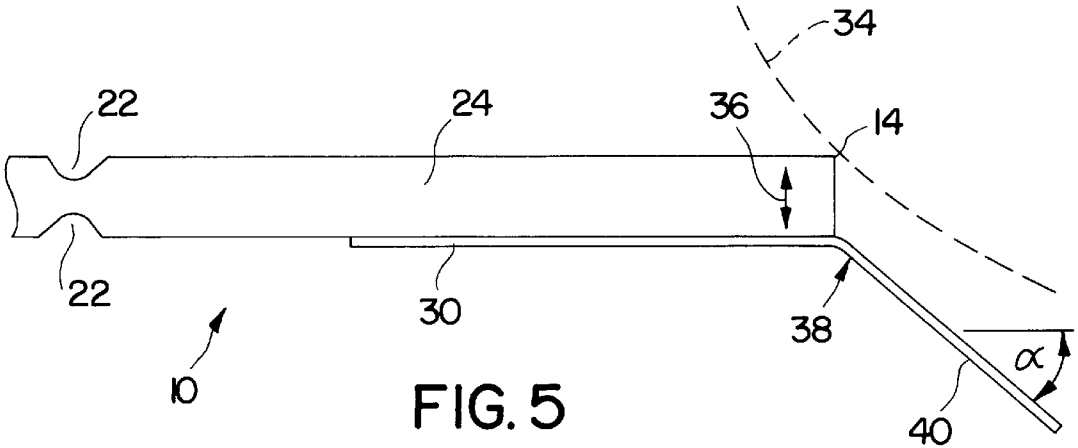

FIG. 5 shows an ink knife 10 adjusted to an ink duct roller 34. The blades of the ink knife 10, which is over 2 mm thick, are cut out by two longitudinal weakening grooves 22 of circle-segment cross section running parallel to the working edge 14. The blades 24 are thus more mobile in the direction of arrow 36.

On the side of the blades 24 facing away from the ink duct roller 34, an angled scraper 38 is glued by its first leg 30 on to blades 24. The leg 40 of angled scraper 38 projecting freely over 3 to 5 cm is folded about an angle a of slightly over 40°.

To summarize it can be found that in particular the following advantages can be achieved with the present invention:

A metal plate 12 for production of an ink knife 10 has a thickness d of over 2 mm, preferably over 3 mm. This avoids the deformation of the blades 24 on adjustment. The screws require no support plate.

Thanks partly to a longitudinal weakening groove 22, the relatively thick blades are mobile to the required extent in the area of working edge 14.

The transverse grooves allow a very narrow slot which can easily be produced with a laser beam and which can be adapted to the viscosity of the ink.

The broad transverse grooves allow, without mechanical effect on the adjacent blades, the arrangement of an angled scraper 38 which is glued to the side of the metal plate 12 facing away from the ink duct roller 34.

I claim:

1. Process which comprises: producing an ink knife for an ink duct roller of a printing machine from a metal plate at least approximately 2 mm thick; forming narrow parallel slots which extend from a working edge of the ink knife over a part of the plate width (b), and forming blades of ink zone width (f), including the steps of (a) first, cutting blind-ended, parallel transverse grooves out of the metal plate at intervals corresponding to the ink zone width (f) starting from the working edge, and (b) then, cutting through the metal plate in the area of the transverse grooves, including the working edge, to form said narrow slots at intervals corresponding to the ink zone width (f).

2. Process according to claim 1, wherein said narrow slots are formed substantially rectangular in shape and are formed having a maximum width of approximately 0.05 mm for each slot.

3. Process according to claim 1, wherein the transverse grooves are cut in a width (c) of 50 to 200% of the plate thickness (d), and a depth (t) of 20 to 80% of the plate thickness (d).

4. Process according to claim 1, wherein said transverse grooves are cut from a metal plate of thickness (d) of 2 to 5 mm, and wherein said transverse grooves are cut to a depth (t) of 1 to d−1 mm.

5. Process according to claim 4, wherein the thickness of the metal plate is approximately 3 mm.

6. Process according to claim 1, wherein said transverse grooves are cut out and have cross-sections selected from the group consisting of rectangular, square, trapezoid, semicircular and circle-segment shape.

7. Process according to claim 1, wherein said transverse grooves are milled out of a metal plate, and a weakening groove is formed in said plate running parallel to the working edge.

8. Process according to claim 7, wherein said metal plate is spring steel.

9. Process according to claim 1, wherein a weakening groove with depth (t) is cut out of the same side of the metal plate as said transverse grooves.

10. Process according to claim 9, wherein the depth of the weakening groove corresponds to the depth of the transverse grooves.

11. Process according to claim 1, wherein a laser beam produces said slots of widths of 0.01 to 0.02 mm.

12. Process according to claim 1, wherein the transverse grooves are filled with an elastic mass which does not penetrate the slots.

13. Process according to claim 12, wherein said elastic mass is selected from the group consisting of an acid-resistant silicon mass and a rubber profile.

14. Process according to claim 1, wherein the transverse grooves in the metal plate, at least in the area of the working edge, are covered with a first leg of an angled scraper, where a second free leg of the angled scraper is bent or folded about an angle.

15. Process according to claim 14, wherein said angle is from 30 to 60°.

16. Process according to claim 1, wherein the slots are formed in the transverse grooves.

17. Process according to claim 1, wherein the first formed grooves are cut part way through the plate, and the second formed slots extend completely through the plate.

18. Process which comprises: producing an ink knife for an ink duct roller of a printing machine from a metal plate at least approximately 2 mm thick; forming narrow parallel slots which extend from a working edge of the ink knife over a part of the plate width (b), and forming blades of ink zone width (f), including the steps of (a) first, cutting blind-ended, parallel transverse grooves out of the metal plate at intervals corresponding to the ink zone width (f) starting from the working edge, and (b) then, cutting through the metal plate in the area of the transverse grooves, including the working edge, to form said narrow slots at intervals corresponding to the ink zone width (f), and wherein the slots are produced with laser beams and a complete weakening groove is cut in the area of blind ends of the transverse grooves running parallel to the working edge.

19. Process according to claim 18, wherein said weakening groove is cut on at least one side of the metal plate.

* * * * *